US005323759A

United States Patent [19]

Hammel et al.

[11] Patent Number: 5,323,759

[45] Date of Patent: Jun. 28, 1994

[54] SEALED BURNER MOUNTING ASSEMBLY

[75] Inventors: John C. Hammel, Belleville; Gary Siburt, Valmeyer, both of Ill.

[73] Assignee: Peerless Premier Appliance Company, Belleville, Ill.

[21] Appl. No.: 75,298

[22] Filed: Jun. 11, 1993

[51] Int. Cl.[5] ..... F24C 3/00

[52] U.S. Cl. ..... 126/39 R; 126/39 B; 126/214 A

[58] Field of Search ..... 126/39 R, 39 B, 41 R, 126/39 C, 39 E, 214 C, 214 R, 211, 214 A

[56] References Cited

U.S. PATENT DOCUMENTS

| | | | |
|---|---|---|---|
| 2,107,972 | 2/1938 | Antrim et al. | 126/214 A |
| 2,507,614 | 4/1950 | Cook et al. | 126/39 R |
| 2,507,660 | 4/1950 | Cook et al. | 126/39 R |
| 2,595,005 | 4/1952 | Shelton et al. | 126/39 R |
| 2,712,818 | 7/1955 | Chambers | 126/39 R |
| 2,972,990 | 2/1961 | Caldwell | 126/39 R |
| 3,015,329 | 2/1962 | Chambers | 126/214 |
| 3,044,459 | 7/1962 | Brown | 126/39 R |
| 3,176,677 | 4/1965 | McArthur, Jr. | 126/214 |
| 3,455,290 | 7/1969 | Kemp | 126/39 R |
| 3,922,138 | 11/1975 | Biddle et al. | |
| 4,354,478 | 10/1982 | Contini | 126/39 E |
| 4,869,231 | 9/1989 | Rice et al. | 126/39 B |
| 5,046,477 | 9/1991 | Bennett et al. | 126/39 R |
| 5,152,276 | 10/1992 | Brock et al. | 126/39 R |

*Primary Examiner*—James C. Yeung
*Attorney, Agent, or Firm*—Kalish & Gilster

[57] ABSTRACT

An assembly for mounting sealed gas burners in a gas stove has a cabinet including upstanding side walls and a main top with spaced-apart burner openings therein mounted on the upstanding side walls. The assembly includes a sub-top mounted on the upstanding side walls of the stove cabinet substantially parallel to and beneath the stove main top so as to effectively span the area bounded by the upstanding side walls of the stove cabinet. The sub-top is adapted for functional connection thereto of gas burners. The assembly is adapted for mounting the sub-top on the upstanding side walls of the stove cabinet. Each of the gas burners extend through a correspondingly positioned opening in the stove main top and are connected to the sub-top in such manner that the main top may be removed from the stove without disturbing the functional connection of the gas burners to the sub-top.

11 Claims, 3 Drawing Sheets

SEALED BURNER MOUNTING ASSEMBLY

FIELD OF THE INVENTION

This invention relates generally to the field of mounting structures for burners in gas stoves, and, more particularly, to a new "sealed" gas burner mounting assembly which permits testing and servicing of such burners with the stove main top opened, away from the burners.

BACKGROUND AND SUMMARY OF THE INVENTION

Historically, gas stoves or "ranges," such as that shown in FIG. 2 of the patent which issued to Brown (U.S. Pat. No. 3,044,459) were provided with a flat main top, or cooking surface having large openings therein for location of the burner heads. The openings were spanned by metal grates for support of a cooking pot above a corresponding burner. Ordinarily in such structures an annular gap was present between the outer surface of the burner head and the edge of the main top burner opening, which gap permitted liquid or food spillover from a cooking pot to flow through, under the main top, and into the stove cabinet or burner chamber beneath the main top. This resulted in a great deal of time and effort being spent in opening the stove main top to clean therebeneath in an effort to prevent the presence of unpleasant odors and the attraction of insects as a result of accumulation of food substances.

This common drawback of older gas ranges was addressed by the advent of a construction for gas stoves in which the gas burner heads were "sealed" to the main top of the range in such a manner that no gap existed between the burner head and the stove main top through which foodstuffs and liquids could enter the burner chamber. (One example of such prior art sealed burner mounting structures is seen in FIG. 7 and is discussed in detail hereafter). The usual sealed gas burner ranges offer a great advantage to modern consumers who are much too busy to spend the time required to disassemble and scrub beneath a stove top at any but the most infrequent intervals.

However, a major disadvantage of previous sealed burner ranges becomes apparent when testing or servicing thereof is necessary. Generally, sealed burners are mounted within the burner chamber on one or more independent brackets and have a burner head structure consisting of at least two parts and which is directly sealed to the main top, for example by screws, in such a way that the burner heads must be completely disassembled in order to remove the stove main top for access to structures therebeneath. These prior art burners cannot be safely lit and the gas supply thereto cannot be initiated unless the burners are fully assembled in their normal functional positions sealed, to the stove main top. Previously, no sealed gas burner ranges existed in which the main top could be removed from the stove, away from the burners during testing or servicing thereof, or to make other adjustments to internal elements of the stove.

Although the precise burner mounting structure varies with different brands of known sealed gas burner ranges, in all cases the entire multi-part burner head must be completely assembled and fully connected to the main top before the burners can be safely lit after servicing or, for example, after installation adjustments. Access to certain stove parts, such as gas pipes and burner ignition wiring, however, can only be accomplished by opening or fully removing the main top of the stove, leaving the burners in an inoperable state.

Therefore, if an adjustment is made, a leak is sealed, etc., it can only be tested for correctness by completely reassembling all of the burner mounting assemblies (usually four), replacing the main top and screwing down all attachments to each burner (normally, at least three screws per burner) before the gas pressure can be turned on and a burner can be lit. This procedure clearly requires a great deal of time and patience to make fine adjustments and may result in careless and inadequate servicing, in addition to being very costly. For example, a single service call, such as to change a stove from liquid propane ("LP") to natural gas, or vice versa, could require four or five separate removals and replacements of the stove main top. This effort is absolutely necessary for safety in lighting and accuracy in testing the stove, in order to ensure proper connection of all gas carrying parts.

Other examples of reasons for service calls requiring access to the inside of the stove and, previously, disassembly of the burners, include to repair leaks, to adjust/replace the air shutters which control air/gas mix going to each separate burner, to replace wires and to replace gas lines. Thus, throughout the useful lifespan of a particular gas range, the known sealed gas burner mounting structures can entail a very large amount of service time, and thus expense, for the stove to function efficiently and safely.

Also, during initial production of a gas stove it is preferred to separately test the integrity of all gas lines and seals under pressure with both natural and liquid propane ("LP") gas, to provide a better, safer product. This formerly entailed complete assembly, testing, disassembly, adjusting, reassembly, retesting and repeating various steps if leaks were discerned or adjustments had to be made. Clearly, this process requires a great deal of time on the production line and thus increases the cost of manufacture substantially. In fact, performing this testing on the production line increases the on-line time for this single step by approximately five fold, from about two to about five minutes.

In order to perform such testing any faster in conventional sealed gas burner ranges on the assembly line would require special equipment and tools not needed for testing non-sealed burner gas ranges or the stove burner mounting structure presently described and claimed. Thus, because of the great increase in manufacturing and end-product cost entailed in adequately testing and adjusting known sealed burner gas stoves, this step is usually simply omitted. Instead, the stove parts are installed and the unit is shipped, delaying the time and expense of burner adjustment and testing for integrity of gas bearing elements.

Ultimately, certain of these steps must then be performed in the consumer's home or other place of stove installation, deferring the cost, but eventually passing it on to the consumer nonetheless. Clearly, for safety reasons, such testing should not be completely foregone; although, in reality it may be omitted by careless delivery personnel, creating a substantial safety risk to the user.

Thus, with the above concerns in mind, the new assembly claimed herein for mounting sealed gas burners in a gas range was developed. Accordingly, it is an object of the present invention to provide an assembly for mounting sealed burners in a gas range in a manner that permits safe lighting and operation of the burners for testing and/or adjustment of the gas lines and other stove elements while the stove main top is open and separated from the burner heads.

It is also an object of the invention that testing and adjustment with the stove main top open, separated from the burners may be performed in the factory, as a final stage of assembly, or at the ultimate site of installation.

It is further among the objects of the present invention to provide an assembly having the features indicated that permits of such adjustment and testing in a quick, facile and economical manner.

It is yet another object of the present invention to provide a burner mounting assembly having the features indicated that consists of few parts relative to prior constructions, which parts are largely formed of commonly available materials, and is simple and economical to assemble.

It is also among the objects of the present invention to provide a gas burner mounting assembly in which the burner units are not formed of multiple pieces, but consist of one piece burner heads, each with an integral gas pipe fixed thereto.

It is further among the objects of the present invention having the above features to permit rapid, economical adjustment and testing of sealed gas burners and related parts in a gas stove during manufacture thereof on an assembly line, or otherwise.

Thus, in furtherance of the above objects, the invention is, briefly, a sealed gas burner mounting assembly for mounting sealed gas burners in a gas stove having a cabinet including upstanding side walls and a main top with spaced-apart burner openings therein and which is mounted on the upstanding side walls. The assembly includes a sub-top mounted on the upstanding side walls of the stove cabinet substantially parallel and beneath the stove main top so as to effectively span the area bounded by the upstanding side walls of the stove cabinet. The sub-top is adapted for functional connection thereto of at least one gas burner. The assembly is adapted for mounting the sub-top on the upstanding side walls of the stove cabinet. The assembly also includes at least one gas burner. Each of the gas burners extends through a correspondingly positioned opening in the stove main top and is functionally connected to the sub-top in such manner that the main top may be removed from the stove without disturbing the functional connection of the at least one gas burner to the sub-top. The assembly furhter includes an adapatation for connecting the at least one gas burner to the sub-top.

The invention is also, briefly, the combination of a gas stove and a sealed burner mounting assembly. The gas stove has a cabinet with upstanding side walls and a main stove top mounted substantially horizontally on top edges of the upstanding side walls of the cabinet of the stove. A divider is positioned transversely within the upstanding side walls parallel to and spacedly beneath the main top of the cabinet so as to define a burner chamber therein, the divider forming a floor of the burner chamber. The sealed burner mounting assembly includes a sub-top mounted within the stove cabinet substantially adajacent and parallel to and beneath the stove main top so as to span the area bounded by the upstanding side walls of the stove cabinet. The sub-top has at least one aperture formed therethrough for receiving a gas burner head therein. The assembly is adapted for mounting the sub-top within the stove cabinet, and there is at least one gas burner having a one-piece head and a gas pipe having inner and outer ends integrally connected at its inner end to the one-piece head. The gas pipe extends forwardly within the burner chamber beneath the sub-top and is connected at its outer end to a burner control on the stove cabinet. The gas pipe is journaled at the inner end thereof in a correspondingly sized aperture in the sub-top, and the one-piece head is removably connected to the subtop, being positioned above and connected to the sub-top in such manner that the main top may be removed from the stove for servicing and testing the at least one gas burner without requiring removal thereof from its normal functional position on the sub-top. The assembly also includes an adaptation for functionally connecting the one-piece head of the at least one gas burner to the sub-top so that removal of the stove main top from its normal position for cooking does not require movement of the assembly, nor impair normal functioning of the burner head while the stove main top is removed.

Other objects will be in part apparent and in part pointed out hereinbelow.

BRIEF DESCRIPTION OF THE DRAWINGS

Throughout the figures and the specification, like numbers will be used to denote like elements.

DESCRIPTION OF THE PREFERRED EMBODIMENT

Figure 1:
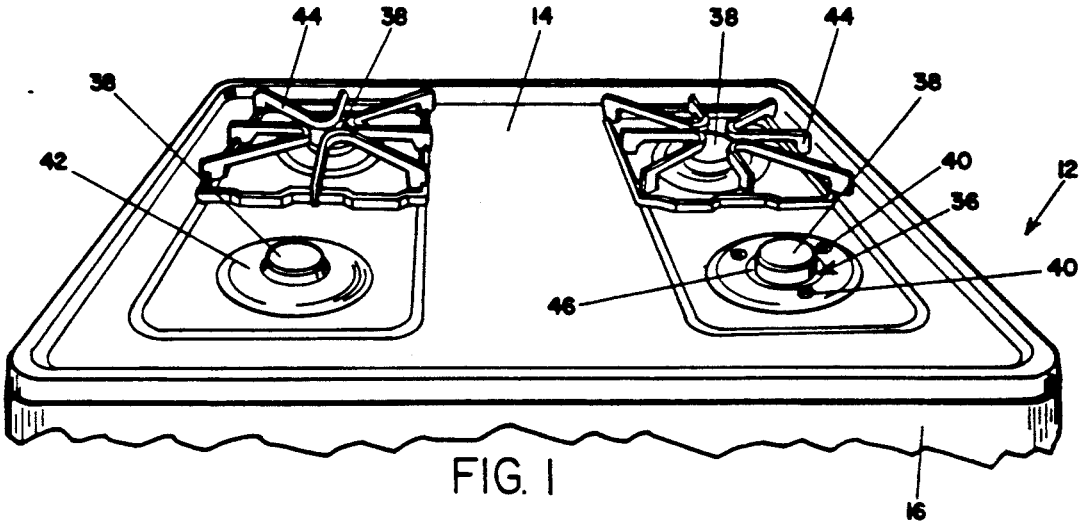
FIG. 1 is a front perspective view of a main top of a sealed gas burner range having a sealed burner mounting assembly in accordance with the invention.

With reference to the drawings, 10 generally indicates the new sealed gas burner mounting assembly constructed in accordance with and embodying the present invention.

Assembly 10 is installed within the top portion of a gas stove generally designated 12, having the usual construction with a main top 14 (or "cook top") which is mounted horizontally on a stove cabinet consisting of front, right, left and rear upstanding side walls, 16, 18, 20 and 22, respectively, in the usual manner. Beneath main top 14 and within walls 16, 18, 20 and 22 there is formed a burner chamber 24 having a horizontal floor which consists of a divider 26 which extends between walls 16, 18, 20, 22 to which it is attached. Stove 12 also has the usual burner control knobs 28 mounted on the upper portion of the front wall 16 for operating the sealed gas burners, to be described hereafter, in the ordinary manner. Known air shutters 30, gas lines 32 and electric ignition wires 34 for lighting and adjusting the gas flame are located behind front wall 16, ordinarily directly behind the position of control knobs 28, and within burner chamber 24.

FIG. 1 illustrates the top of a gas range or stove 12 having assembly 10 mounted therein. Main top 14 of stove 12 has four circular openings 36 therein for passage through each opening of a burner head 38. Although shown to be identical in this example, burner heads 38 could vary in size from one another, and, of course, there could be more or fewer burner heads, as desired.

Main top 14 is secured downwardly, preferably by three screws 40 positioned around each opening 36, and, if desired, made tight by wing nuts (not shown), or other connectors threadably attached thereto. In FIG. 1 the heads of screws 40 are shown, positioned spacedly around the right, front burner. However, they are ordinarily covered by a decorative and protective ring 42 as shown on the left, front burner and in FIG. 2. For use, a grate 44 covers each burner head 38 for support of a cooking pot thereon.

Figure 2:
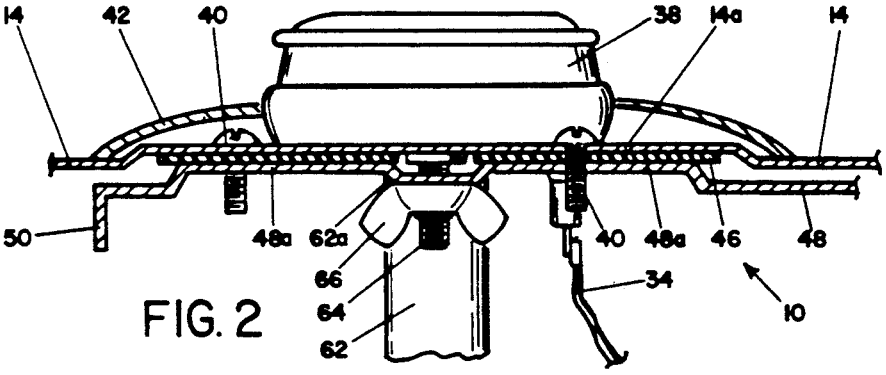
FIG. 2 is a vertical, partial sectional view of the front left burner of the assembly of FIG. 1.
Figure 3:
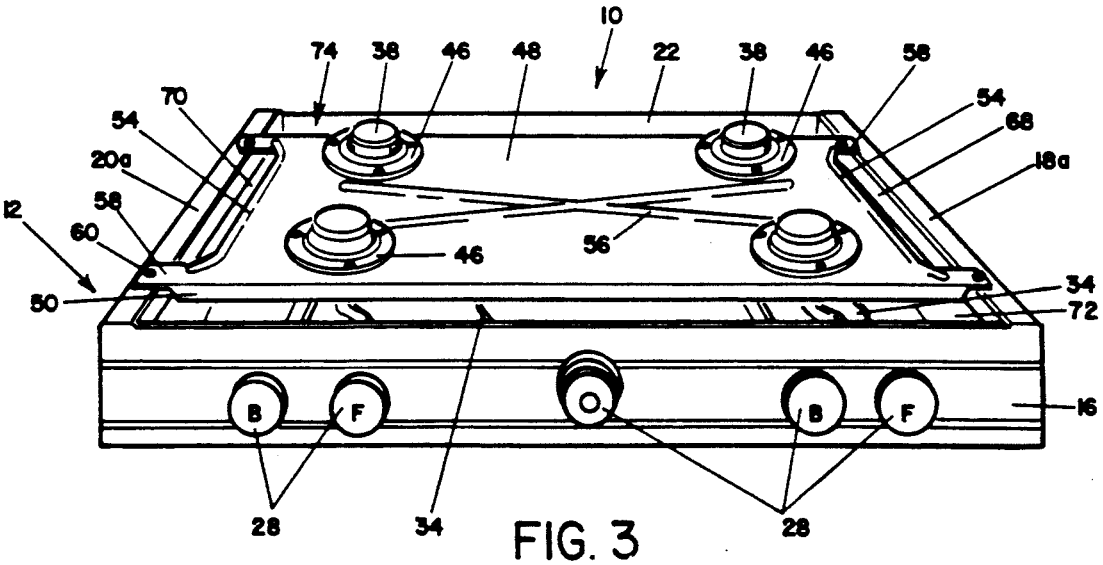
FIG. 3 is a front perspective view of the assembly shown in FIG. 1, with the main top of the stove removed to reveal the construction therebeneath.
Figure 4:
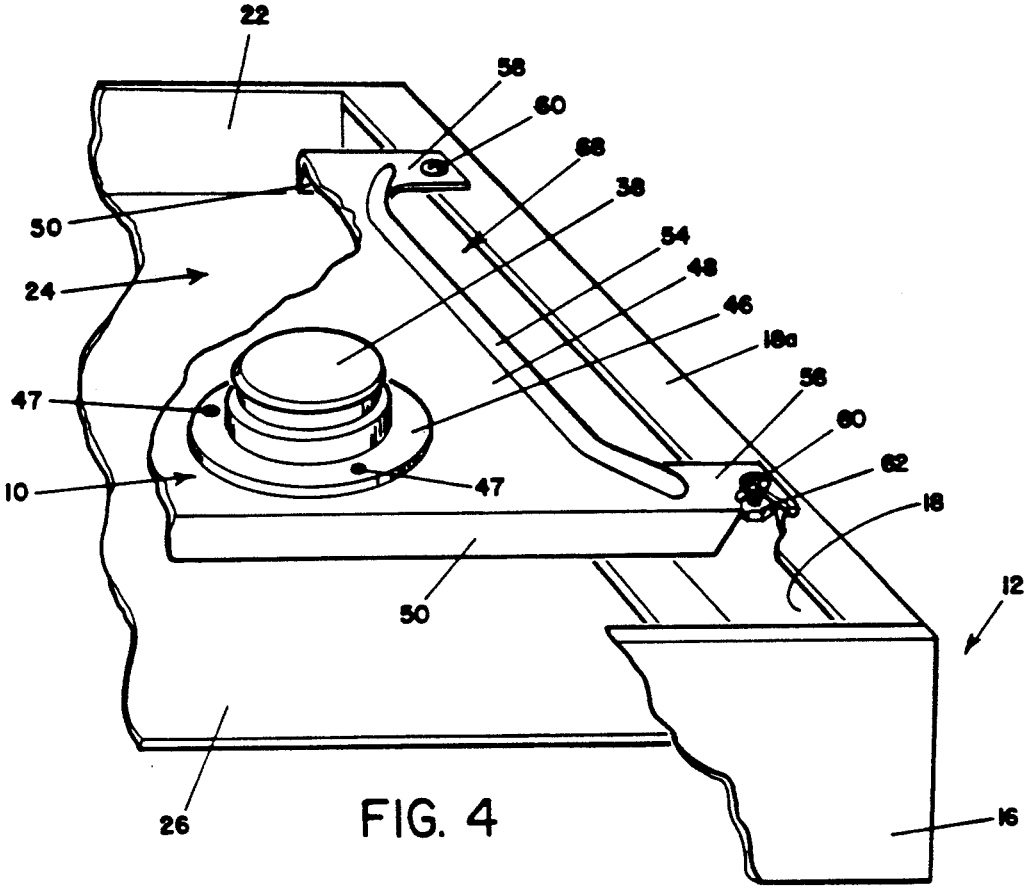
FIG. 4 is a partial sectional view of the stove top of FIG. 3, partly broken away to illustrate the connection of a sub-top of the new sealed gas burner mounting assembly and the interior of the burner chamber of the stove.
Figure 5:
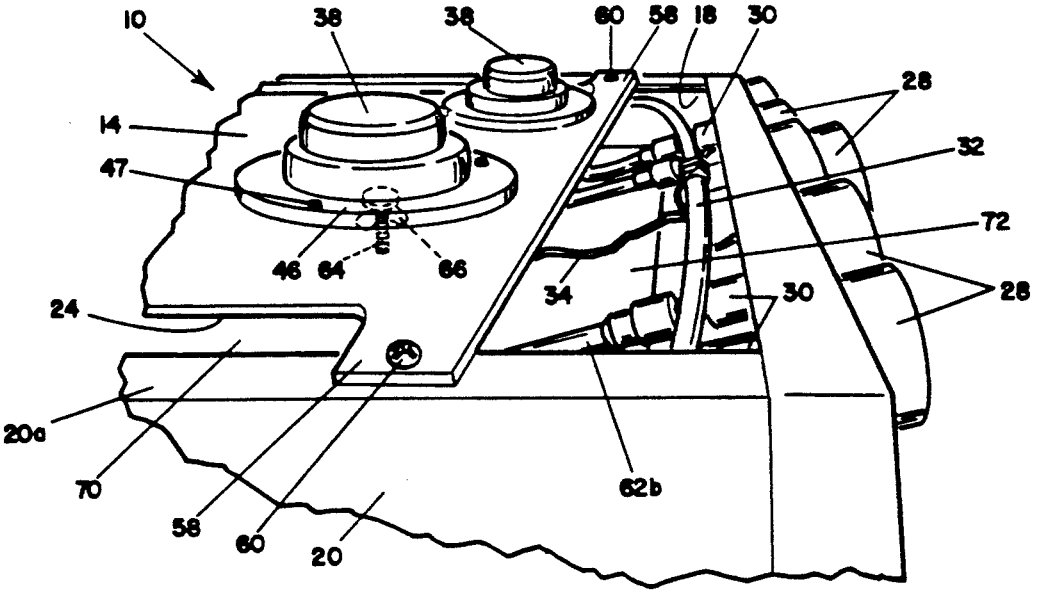
FIG. 5 is a left side perspective view of the stove top of FIG. 3, partially broken away, showing the front burners and interior of the burner chamber.

FIG. 2 illustrates that beneath ring 42 screws 40 pass downwardly through a raised circular area 14*a* of main top 14 and continue downwardly through screw holes 47 in gasket 46 and further downwardly through holes 41 in a matching raised, disk-shaped area 48*a* of a sub-top 48. Although the foregoing construction is preferred, it is conceivable that gasket 46 may be omitted if other sealing means are provided. Gasket 46, if present, must be sufficiently heat resistant in its snug position proximate burner head 38 to withstand the heat generated thereby. Ideally, gasket 46 is formed of silicon rubber for ease of manipulation, tight fit and longevity.

As seen in FIGS. 2 through 6, sub-top 48 is preferably substantially rectangular and flat, and is ordinarily formed of metal. Sub-top 48 has, in the present example, depending front and rear edges 50 (omitted from FIG. 5 for clarity), which are preferably identical and reversible and may be interchanged, forward and back, sub-top 48 being symmetrical, side to side and front to back for economy and ease of manufacture. That is, the sub-top may be rotated 180° and still function satisfactorily.

Opposed, parallel left and right edges 52 of sub-top 48 are each preferably provided with a contiguous raised area 54 which corresponds in height to a raised cross-shaped section 56 optionally formed centrally on sub-top 48 for providing a very slight spacing between main top 14 and sub-top 48, as well as adding structural strength to sub-top 48.

Sub-top 48 is preferably provided at each corner with horizontally extending flanges 58, each of which has an aperture (not shown) for penetration thereof by a metal screw 60. Each screw 60 passes downwardly through a corresponding flange 58 and continues downwardly through an opening (not shown) in inwardly turned edges 18*a*, 20*a* of upstanding side walls 18, 20, respectively, of stove 12. These screws 60 are secured in position preferably by nuts 62 for secure attachment of sub-top 48 to stove 12 beneath and adjacent to main top 14.

The described connection of sub-top 48 at the four corners thereof to side walls 18, 20 of the stove cabinet necessarily provides a degree of strength and stability to stove 12. Although the above construction is preferred, alternatively, sub-top 48 could be turned 90 degrees and connected by corner flanges or otherwise to the front and back side walls of the associated stove cabinet. Additionally, if desired, sub-top 48 could be divided transversely or longitudinally, and house only two burner uits, for example, rather than the preferred four.

Figure 6:
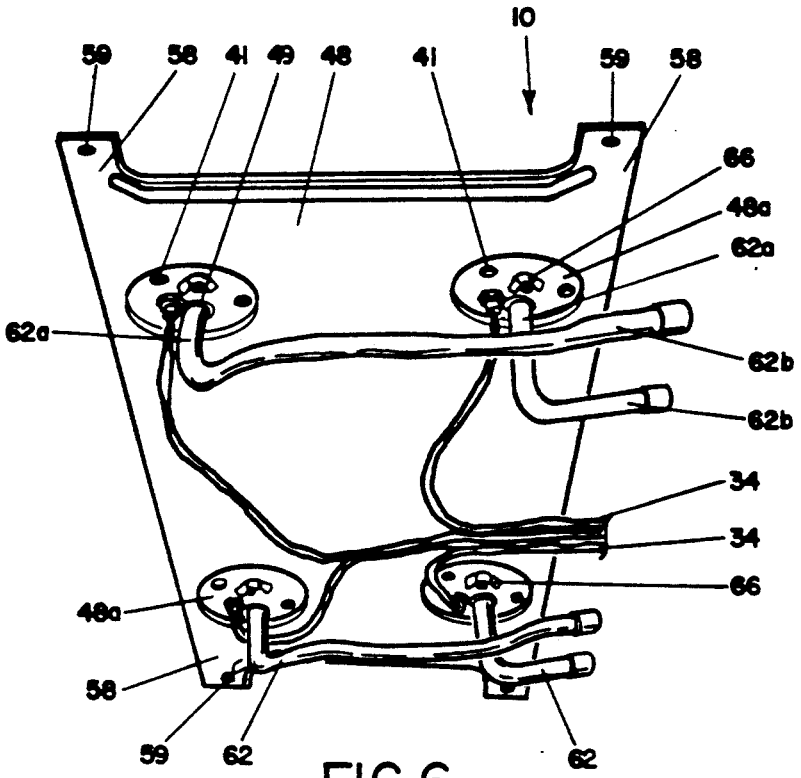
FIG. 6 is a bottom perspective view of the left end of the sub-top of the sealed burner mounting assembly of FIG. 3.

With reference to FIGS. 2 and 6, it will be seen that one-piece burner head 38 is connected to a burner gas pipe 62 at an inward end 62*a* thereof. Pipe 62 and burner head 38 compose together one integral burner unit. The outer end 62*b* of each burner pipe 62 extend forwardly and ultimately connect with and are controlled by control knobs 28. Each burner pipe 62 may vary somewhat from one another in shape and length as necessary to reach from the normal use position of an attached burner head 38 forwardly to a respective control 28, and, for example, as shown in the figures.

FIG. 6 illustrates that sub-top 48 is provided with spaced-apart apertures 49 which are sized and situated appropriately for passage therethrough and journaling of an inner end 62*a* of a burner pipe 62. Thus, with reference also to FIGS. 1 and 2, with a pipe end 62*a* so situated, the attached burner head 38 rests firmly on the sub-top 48, preferably with gasket 46 between the upper surface of the sub-top and the lower surface of the burner head. However, each burner head 38 is not on top of main stove top 14, but rather is located within a burner opening 36 of the main top. Also, each burner head is selectively removably secured to sub-top 48 by a bolt 64 which is connected to burner head 38 and extends downwardly therefrom through sub-top 48. Bolts 64 are removably secured in position by a correspondingly threaded wing nut 66 for facile attachment and removal.

Thus, when installed in the preferred manner, a gasket 46 is sandwiched between the raised areas 14*a*, 48*a* of main top 14 and sub-top 48, respectively, and pipe 62 connected to each corresponding burner head 38 extends downwardly through each layer formed by areas 14*a*, 48*a*. However, a head 38 passes only through an opening 36 in main top 14 and comes to rest on gasket 46, if any is used. If gasket 46 is lacking, of course, burner head 38 will rest directly upon the upper surface of sub-top 48. Conceivably, in that case sealing means other than gasket 46 will suffice, for example, some type of heat-resistant caulking compound.

FIGS. 3 through 6 show that between all edges of sub-top 48 and corresponding adjacent stove cabinet walls 16, 18, 20, 22 there are spaces remaining for access to all elements within burner chamber 24 beneath sub-top 48. Thus, inwardly of side wall edges 18*a*, 20*a* there are formed spaces 68, 70 and behind front wall 16 but before depending flange 50 there is a large space 70 and forwardly of back wall 22 is a space 74 rearwardly of rearward depending flange 50. So, for example, air shutters 30 are easily accessed for servicing, adjustment or replacement via gap 72 and each wing nut 66 attached to a burner head 38 may be accessed by the nearest gap 68, 70, 72, 74, as the case may be. By simply reaching in and releasing wing nut 66 the associated burner head may be released, and, if it is necessary to replace the burner unit, outer end 62*b* can be disconnected from the burner controls and the complete pipe pulled upwardly and through the associated aperture 49 in sub-top 48. Forward (outer) end 62*b* of each pipe 62 may be accessed simply by reaching into opening 72 after main top 14 has been lifted up and away from the upstanding side walls 16, 18, 20, 22 of stove 12. Accordingly, the present sealed burner mounting assembly does not require complete disassembly in order to service the burner units thereof.

Figure 7:
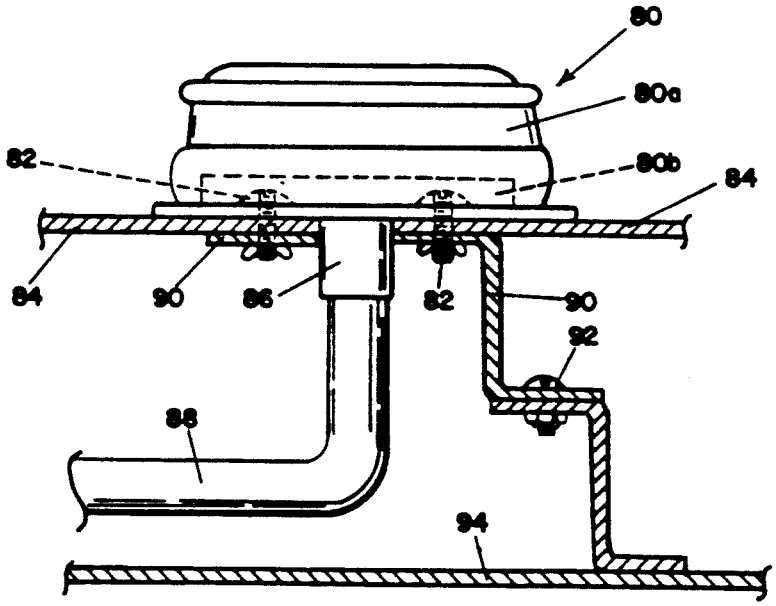
FIG. 7 (PRIOR ART)
FIG. 7 is a partial vertical sectional view of a burner mounting structure for a sealed gas burner such as is known in the prior art, taken through a gas stove (not shown) main top.

The contrasting structure of a typical prior art sealed gas burner is illustrated in FIG. 7 wherein it is shown that a multi-piece burner head 80 consisting of outer portion 80*a* and inner portion 80*b* is connected by screws 82 which penetrate the inner portion 80*b* and may be covered, as shown, by the outer portion 80*a*. In either case, screws 82 penetrate downwardly through and connect a portion of hte burner head directly to main top 84.

The multi-piece burner head 80 may be separated from main top 84 by a gasket of some type. However, there is no suggestion of a sub-top separately mounted within the stove cabinet. Rather, each multi-piece burner head is usually connected by a collar 86 to a burner gas pipe 88. Each burner head is separately connected by a bracket 90 and screw 92 attachment to a burner chamber floor 94. The bracket attachment and connected burner may take many forms, but in any case, it is axiomatic that such multi-piece burner heads must be entirely assembled and attached to the main top of the stove before the burner can be lit.

Thus, because of the structural connection to the stove main top the entire burner and stove must be all assembled before lighting of any particular burner or testing thereof. Because of these structural limitations it is impossible in known sealed gas ranges to have the main top removed and service or test a particular burner or the various elements attached thereto.

Of course, variations on the above preferred embodiment are conceived which would still be in keeping with the invention. For example, although sub-top 48 is described as being mounted to in-turned upper edges of upstanding side walls of a stove cabinet, it could be connected in some other fashion to the stove cabinet walls (such as the inner vertical surfaces thereof), and function just as well. Sub-top 48 with the burner units installed as described could even be attached, for example by flange and bolt assemblies, to the interior of a kitchen cabinet beneath the main top of a built-in cooking unit, or hob, above a cupboard or drawer, rather than as part of the usual cooking surface and oven combination, without departing from the scope of the invention.

It is clear from the foregoing description and the figures that the structure of the new sealed gas burner mounting assembly, i.e., the positive relative location of the one-piece burner heads relative to the sub-top, rather than being tied in to the main stove top to be usable, permits rapid, on-line testing at the end of the production line. Faster manufacture of course is cheaper manufacture, and, in this case, rather than sacrificing quality for speed, quality of the product is actually improved. Further adjustment and servicing after installation is also made vastly more efficient and thereby less expensive, a further great advantage to the consumer.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An assembly for mounting sealed gas burners in a gas stove having a cabinet including upstanding side walls and a main top with spaced-apart burner openings therein and mounted on the upstanding side walls, the assembly comprising:

a. a sub-top mounted on the upstanding side walls of the stove cabinet substantially parallel and beneath the stove main top so as to effectively span substantially the entire area front to back and side to side bounded by the upstanding side walls of the stove cabinet, said sub-top being adapted for functional connection thereto of at least one sealed gas burner;

b. means for mounting said sub-top on the upstanding side walls of the stove cabinet;

c. at least one sealed gas burner, each of said at least one sealed gas burner extending through a correspondingly positioned opening in the stove main top and being functionally connected to said sub-top in such manner that the main top may be removed from the stove without disturbing the functional connection of said at least one sealed gas burner to said sub-top;

d. means for connecting said at least one sealed gas burner to said sub-top.

2. The assembly of claim 1, wherein said sub-top has at least one aperture formed therethrough for receiving a pipe of a sealed gas burner therein, and said at least one sealed gas burner has a head and an integral pipe, said pipe being journaled in a correspondingly sized aperture in said sub-top for passage to said burner head of either one of natural and L.P. gas from a main gas source to the burner head.

3. The assembly of claim 2 wherein the head of said at least one sealed gas burner is formed of one piece.

4. The assembly of claim 2, wherein said sub-top is provided with an opening adjacent to the at least one aperture for journaling said burner pipe, and further wherein the means for removably connecting said at least one sealed gas burner head to said sub-top comprises a bolt fixed to said at least one sealed gas burner head and extending downwardly therefrom through the opening in the sub-top, and a wing-nut is threadably attached to the bolt beneath said sub-top for facilely tightening said at least one sealed gas burner head in a position superior and flush in relation to said sub-top.

5. The assembly of claim 1, and further comprising means for sealing the stove main top to said sub-top, said means for sealing being located between the stove main top and said sub-top and surrounding said at least one sealed gas burner head in close-fitting relationship thereto.

6. The assembly of claim 5, wherein said means for sealing comprises an annular gasket formed of thin, sheet-like material which is sufficiently resistant to heat to withstand the heat formed in the stove main top and said sub-top during operation of the corresponding gas burner which said means for sealing surrounds.

7. The assembly of claim 6, wherein the gasket is formed of silicon rubber.

8. The assembly of claim 1, and further comprising means for removably connecting the stove main top to said sub-top in a manner which permits rapid, selective, replaceable removal of the stove main top from its normal position on the upstanding side walls of the stove cabinet above the sub-top, while not requiring disassembly of said at least one sealed bas burner nor any other elements attached to said at least one burner head in order to permit it to be functional.

9. The assembly of claim 8, wherein said means for removably connecting the stove main top to said sub-top comprises at least one screw which penetrates the stove main top and extends downwardly, adjacent said at least one burner head, through the stove main top and the sub-top and is secured therebeneath by a nut.

10. The assembly of claim 1, wherein said sub-top is substantially rectangular and flat and has a flange extending outwardly from each corner, each flange having a through-hole for passage therethrough of a screw, and further wherein said means for mounting said sub-top on the upstanding side walls of the stove comprises a plurality of screws, one of such screws penetrating each of the through-holes of the flanges on said sub-top and passing into apertures formed in an inturned upper edge of each of the upstanding side walls of the stove cabinet.

11. The combination of a gas stove having a cabinet with upstanding side walls and a main stove top mounted substantially horizontally on top edges of the upstanding side walls of the cabinet of said stove, a divider positioned transversely within the upstanding side walls parallel to and spacedly beneath the main top of the cabinet so as to define a burner chamber therein, the divider forming a floor of the burner chamber; and a sealed burner mounting assembly comprising:

a. a sub-top mounted within the stove cabinet substantially adajacent and parallel to and beneath the stove main top so as to span the area bounded by the upstanding side walls of the stove cabinet, said sub-top having at least one aperture formed therethrough for receiving a gas burner head therein;

b. means for mounting said sub-top within the stove cabinet;

c. at least one gas burner having a one-piece head and a gas pipe having inner and outer ends integrally connected at its inner end to the one-piece head, extending forwardly within the burner chamber beneath the sub-top and being connected at its outer end to a burner control on the stove cabinet, the gas pipe being journaled at the inner end thereof in a correspondingly sized aperture in said sub-top, and the one-piece head being removably connected to the subtop being positioned above and connected to the sub-top in such manner that the main top may be removed from the stove for servicing and testing said at least one gas burner without requiring removal thereof from its normal functional position on said sub-top;

d. means for connecting the one-piece head of said at least one gas burner to said sub-top so that removal of the stove main top from its normal position for cooking does not require movement of said assembly, nor impair normal functioning of said burner head while the stove main top is removed.

* * * * *

UNITED STATES PATENT AND TRADEMARK OFFICE

CERTIFICATE OF CORRECTION

PATENT NO. : 5,323,759

DATED : June 28, 1994

INVENTOR(S) : Hammel, J.C. and Siburt, G.

It is certified that error appears in the above-identified patent and that said Letters Patent is hereby corrected as shown below:

In the Claims:

Claim 6, Column 8, Line 60, before "gas" insert --sealed--.

Signed and Sealed this

Sixth Day of September, 1994

*Attest:*

Bruce Lehman

BRUCE LEHMAN

*Attesting Officer*

*Commissioner of Patents and Trademarks*